US011510450B2

(12) United States Patent
Wendelrup

(10) Patent No.: US 11,510,450 B2
(45) Date of Patent: Nov. 29, 2022

(54) AIRBAG SYSTEM

(71) Applicant: HÖVDING SVERIGE AB, Malmö (SE)

(72) Inventor: Heino Wendelrup, Bjärred (SE)

(73) Assignee: HÖVDING SVERIGE AB, Malmö (SE)

( * ) Notice: Subject to any disclaimer, the term of this patent is extended or adjusted under 35 U.S.C. 154(b) by 206 days.

(21) Appl. No.: 16/626,605

(22) PCT Filed: Jun. 28, 2018

(86) PCT No.: PCT/SE2018/050702
§ 371 (c)(1),
(2) Date: Dec. 26, 2019

(87) PCT Pub. No.: WO2019/004918
PCT Pub. Date: Jan. 3, 2019

(65) Prior Publication Data

US 2020/0154814 A1 May 21, 2020

(30) Foreign Application Priority Data

Jun. 29, 2017 (SE) ..... 1750845-8

(51) Int. Cl.
*A42B 3/04* (2006.01)
*A41D 13/018* (2006.01)
*A41D 13/05* (2006.01)

(52) U.S. Cl.
CPC ..... *A42B 3/0486* (2013.01); *A41D 13/018* (2013.01); *A42B 3/046* (2013.01)

(58) Field of Classification Search
CPC ..... A42B 3/0486; A42B 3/046; A42B 3/00; A42B 3/122; A41D 13/018;
(Continued)

(56) References Cited

U.S. PATENT DOCUMENTS 5,039,035 A * 8/1991 Fitzpatrick ..... A42B 3/0486 244/122 AG
6,043,736 A * 3/2000 Sawahata ..... B60N 2/002 280/735
(Continued)

FOREIGN PATENT DOCUMENTS

DE 19754541 A1 6/1999
EP 2313814 B1 4/2011
(Continued)

OTHER PUBLICATIONS

PCT International Search Report and Written Opinion, Application No. PCT/SE2018/050702, dated Jul. 20, 2018.

*Primary Examiner* — Robert H Muromoto, Jr.
(74) *Attorney, Agent, or Firm* — Dilworth IP, LLC

(57) ABSTRACT

An airbag system for protecting a body part of a user in case of an accident is provided. The system including an airbag adapted for inflation upon an accident occurring during an intended activity, at least one sensor configured to measure movements of the airbag system, and thus indirect the movements of the user and a control unit configured to determine if the user is in a first activity state not corresponding to the intended activity by processing the output from the at least one sensor.

14 Claims, 5 Drawing Sheets

(58) Field of Classification Search
CPC ..... A41D 2600/104; B60R 2021/0088; B60R 2021/01088; B60R 2021/01211
See application file for complete search history.

(56) References Cited

U.S. PATENT DOCUMENTS 6,125,478 A * 10/2000 Alaloof ..... A41D 13/018 2/456
6,139,050 A * 10/2000 Bultel ..... A41D 13/018 280/730.1
6,480,144 B1 * 11/2002 Miller ..... B60R 21/013 180/167
6,499,763 B1 * 12/2002 Mishima ..... B60R 21/18 280/733
6,584,911 B2 * 7/2003 Bergerson ..... B60R 21/264 102/530
6,908,103 B2 * 6/2005 Umeda ..... A41D 13/018 2/462
7,083,187 B2 * 8/2006 Akiyama ..... B62J 27/00 280/730.1
7,150,048 B2 * 12/2006 Buckman ..... A41D 13/018 2/465
7,322,605 B2 * 1/2008 Ventura ..... B60N 2/06 280/735
7,343,632 B2 * 3/2008 Neron ..... A41D 13/018 2/456
7,484,751 B2 * 2/2009 Goto ..... A41D 13/018 280/728.1
7,712,777 B2 * 5/2010 Breed ..... G01S 7/4802 280/735
7,988,190 B2 * 8/2011 Breed ..... B60R 21/0134 280/735
8,140,227 B2 * 3/2012 Imamura ..... B60R 21/0134 701/45
8,402,568 B2 * 3/2013 Alstin ..... A41D 13/0512 2/413
8,551,030 B2 * 10/2013 Jenkins, III ..... A41D 13/0512 602/18
8,947,195 B1 * 2/2015 Anvari ..... A42B 3/046 340/3.1
9,007,217 B1 * 4/2015 Anvari ..... H01Q 21/28 340/573.1
9,241,528 B2 * 1/2016 Partlo ..... A42B 3/046
9,364,033 B2 * 6/2016 Kim ..... A41D 13/018
9,622,520 B2 * 4/2017 Fenyves ..... B60R 21/231
9,661,890 B2 * 5/2017 Weatherby ..... A42B 3/0433
9,758,124 B2 * 9/2017 Kruse ..... B60R 21/2338
9,788,588 B2 * 10/2017 Allen ..... A42B 3/12
9,868,046 B2 * 1/2018 Weatherby ..... A42B 3/0433
9,949,516 B2 * 4/2018 Pickett ..... A42B 3/046
9,956,933 B2 * 5/2018 Wahl ..... B62J 27/00
9,994,177 B2 * 6/2018 Shimazu ..... B60R 21/0136
10,001,346 B2 * 6/2018 Augustine ..... A41D 13/018
10,004,973 B2 * 6/2018 Weatherby ..... A42B 3/30
10,005,414 B2 * 6/2018 Kim ..... B60W 50/0098
10,011,241 B2 * 7/2018 Lanter ..... G01D 5/145
10,053,039 B2 * 8/2018 Furst ..... B60R 21/0132
10,232,814 B2 * 3/2019 Gandhi ..... B60N 2/914
10,244,810 B2 * 4/2019 Martin ..... A42B 3/046
10,252,693 B2 * 4/2019 Numazawa ..... B60N 2/143
10,271,591 B2 * 4/2019 Bangera ..... A41D 31/285
10,390,580 B2 * 8/2019 Olsson ..... A42B 3/0486
10,421,425 B2 * 9/2019 Foltin ..... B60R 21/01512
10,426,214 B2 * 10/2019 Rabinovitch ..... A42B 3/122
10,682,578 B1 * 6/2020 Malatek ..... B60R 21/02
10,721,978 B2 * 7/2020 Li ..... A41D 13/018
10,925,331 B2 * 2/2021 Mazzarolo ..... A41D 13/018
11,000,078 B2 * 5/2021 Jin ..... A61B 5/1117
11,052,860 B2 * 7/2021 Zeng ..... B60R 21/261
2002/0158455 A1 * 10/2002 Bergerson ..... F42B 3/124 280/737
2003/0023361 A1 * 1/2003 Umeda ..... B60R 21/0134 701/45
2003/0222439 A1 * 12/2003 Akiyama ..... B60R 21/276 280/730.1
2004/0066023 A1 * 4/2004 Joseph ..... B60R 21/01526 280/735
2004/0178612 A1 * 9/2004 Tabe ..... B60R 21/0152 280/735
2005/0067816 A1 * 3/2005 Buckman ..... A61B 5/6805 280/730.1
2005/0179239 A1 * 8/2005 Farmer ..... B60R 21/01538 280/735
2007/0096446 A1 * 5/2007 Breed ..... B60R 21/239 280/735
2007/0096447 A1 * 5/2007 Tabe ..... B60R 21/01516 280/735
2007/0108748 A1 * 5/2007 Ventura ..... B60R 21/01554 280/735
2008/0042409 A1 * 2/2008 Breed ..... B60R 21/0134 280/735
2008/0282453 A1 * 11/2008 Alstin ..... A41D 13/0512 2/413
2010/0004827 A1 * 1/2010 Imamura ..... B60R 21/0134 701/45
2011/0154561 A1 * 6/2011 Singhal ..... A41D 13/018 2/455
2011/0288459 A1 * 11/2011 Jenkins, III ..... A61B 5/11 602/18
2013/0276213 A1 * 10/2013 Olsson ..... A42B 3/0486 2/413
2013/0326800 A1 * 12/2013 Kim ..... A41D 13/05 2/455
2014/0100742 A1 * 4/2014 Furst ..... B60R 21/0136 701/46
2014/0188347 A1 * 7/2014 Tabe ..... B60R 21/0152 701/45
2014/0230135 A1 * 8/2014 Fenyves ..... B60R 21/231 2/455
2015/0157080 A1 * 6/2015 Camarillo ..... A42B 3/0473 2/459
2015/0245680 A1 * 9/2015 Partlo ..... A42B 3/046 2/411
2016/0169630 A1 * 6/2016 Augustine ..... A41D 13/0512 2/468
2016/0207486 A1 * 7/2016 Wahl ..... B60R 22/00
2016/0270472 A1 * 9/2016 Allen ..... A42B 3/0486
2016/0339860 A1 * 11/2016 Shimazu ..... B60R 21/0134
2016/0362077 A1 * 12/2016 Lanter ..... G01D 5/145
2017/0035139 A1 * 2/2017 Weatherby ..... A63B 71/081
2017/0072897 A1 * 3/2017 Kruse ..... B60R 21/203
2017/0225058 A1 * 8/2017 Weatherby ..... A42B 3/0433
2017/0261343 A1 * 9/2017 Lanter ..... G01D 5/147
2017/0295881 A1 * 10/2017 Martin ..... A42B 3/122
2018/0027894 A1 * 2/2018 Bangera ..... A41D 31/285
2018/0027895 A1 * 2/2018 Pickett ..... A42B 3/122
2018/0086295 A1 * 3/2018 Ewert ..... B60R 21/013
2018/0104565 A1 * 4/2018 Weatherby ..... A63B 71/081
2018/0345896 A1 * 12/2018 Werner ..... B60R 21/231
2019/0001909 A1 * 1/2019 Yang ..... B60R 21/0132
2019/0014850 A1 * 1/2019 Johnson, Jr. ..... A42B 3/046
2019/0110530 A1 * 4/2019 Jin ..... A41D 13/0155
2019/0166945 A1 * 6/2019 Martin ..... A42B 3/28
2019/0223525 A1 * 7/2019 Mazzarolo ..... A41D 13/018
2020/0010077 A1 * 1/2020 Cormack ..... B60W 40/08
2020/0062202 A1 * 2/2020 Umezawa ..... B60R 21/36
2020/0139913 A1 * 5/2020 Wendelrup ..... B60R 21/01
2020/0154813 A1 * 5/2020 Wendelrup ..... A42B 3/00
2020/0154814 A1 * 5/2020 Wendelrup ..... A42B 3/00
2020/0170328 A1 * 6/2020 Yan ..... A42B 3/0473
2020/0188802 A1 * 6/2020 Malatek ..... A61B 5/702
2020/0281300 A1 * 9/2020 Shakespeare ..... A42B 3/122
2020/0329789 A1 * 10/2020 Cholhan ..... A41D 13/018
2020/0353887 A1 * 11/2020 Zeng ..... B60R 21/233
2021/0045486 A1 * 2/2021 Park ..... A42B 3/30

(56) References Cited

U.S. PATENT DOCUMENTS

| | | | | |
|---|---|---|---|---|
| 2021/0052024 | A1* | 2/2021 | Mazzarolo | A41D 13/0155 |
| 2021/0161221 | A1* | 6/2021 | Mazzarolo | A41D 13/018 |

FOREIGN PATENT DOCUMENTS

| | | | |
|---|---|---|---|
| WO | 9852433 | A1 | 11/1998 |
| WO | 2012044245 | A1 | 4/2012 |
| WO | 2017013300 | A1 | 1/2017 |

* cited by examiner

AIRBAG SYSTEM

TECHNICAL FIELD

The present disclosure relates to a system for protecting a user's head in case of an abnormal movement, such as a fall or a collision. More specifically, the present invention relates to a wearable airbag for protecting the head of a bicyclist in case of an accident when biking.

BACKGROUND

Airbags for the protection of a person's head are known in the art, for example through WO2012044245. As opposed to vehicular airbags the airbag of WO2012044245 is designed to inflate into a complex head protecting shape. The airbag is designed as a double-bag construction, of which the inflated helmet-shape of the inner plastic bag is formed by the finger like construction of the outer bag.

The airbag mentioned in WO2012044245 is designed to detect if the user is exposed to an abnormal movement, such as a fall or a collision, for a specific activity, for example riding a bicycle. For the airbag to protect the user during an accident, the user has to wear the airbag when doing the specific activity. During the activity the wearable airbag is activated, constantly monitoring the movements of the user. As inflation is controlled by comparing the current movement with reference movements of the particular type of activity, it is important to turn off the wearable airbag once the type of activity is changed, e.g. from cycling to walking or running Compared to traditional helmets the wearable airbag is so gently arranged around the neck that a user may easily forget that he or she is actually wearing it. Hence, deactivation of the wearable airbag may be forgotten. There is thus a need for an airbag that eliminates or at least mitigates problems arising from this situation.

SUMMARY

An object of the present invention is to provide a new type of airbag system which is improved over prior art and which eliminates or at least mitigates the drawbacks discussed above. More specifically, an object of the invention is to provide an airbag system that is able to determine if the user is in a first activity state corresponding to an intended activity.

In a first aspect, an airbag system for protecting a body part of a user in case of an accident is provided comprising an airbag adapted for inflation upon an accident occurring during an intended activity, at least one sensor configured to measure movements of the airbag system and thus indirect the movements of the user and a control unit configured to determine if the user is in a first activity state not corresponding to the intended activity by processing the output from the at least one sensor.

In one embodiment, if the control unit detects that the user is in a first activity state, the control unit of the airbag system is configured to put the airbag system in a first mode. In the first mode the control unit may be configured to alert the user and/or configured to automatically put the airbag system in an idle state, and/or alert the user to manually change to idle state. In one embodiment, when the system is in idle state the airbag cannot be inflated. To put the airbag system in an idle state when the user is not doing the indented activity reduces the energy consumption.

The airbag system may further comprises a user interface, wherein said user interface is configured to alert the user by producing a signal detectable by the user.

In one embodiment, if the control unit detects that the user is not in a first activity state, the control unit of the airbag system is configured to automatically put the airbag system in an active state, and/or alert the user to manually change to active state. The control unit may further be configured to determine if the user is in a second activity state by processing the output from the at least one sensor. In one embodiment, if the control unit detects that the user is in a second activity state, the control unit is configured to automatically put the airbag system in an active state, and/or alert the user to manually change to active state.

The system may further comprise an additional sensor configured to detect abnormal movement of a user corresponding to an accident.

In one embodiment, the first activity state is the user doing an activity other than riding a bicycle. The second activity state may be the user riding a bicycle. The intended activity is thus riding a bicycle.

In a second aspect, a method for use in an airbag system is provided. The airbag system comprises an airbag adapted for inflation, at least one sensor configured to measure movements of the airbag system and a control unit. The method comprises receiving movement data from the at least one sensor and determining if the user is in a first activity state based on the received movement data.

The method may further comprise automatically putting the airbag system in an idle state, and/or alerting the user to manually change to idle state, if it is determined that the user is in a first activity state.

BRIEF DESCRIPTION OF THE DRAWINGS

The present invention will hereinafter be further explained by means of non-limiting examples with reference to the appended schematic figures where.

DETAILED DESCRIPTION

The airbag system described herein is configured to be used to detect an accident, such as a fall or collision, for example for when a user is riding a bicycle. The airbag system is thus configured for the specific use of riding a bicycle, i.e. cycling is the intended activity of the airbag system. For the airbag system to protect the user during an accident, the user has to wear the airbag system and have it turned on, or activated when performing the specific activity. It would however be preferred to provide a system that determines if the airbag system is needed and in response to that alert the user and/or change the mode of the airbag system.

Furthermore, having the airbag system set in an activate state when the user is not doing the intended activity, e.g. not cycling, results in an undesirable energy loss since the airbag system is in an active state using battery power to power a sensor(s) and to process the movement data gathered therefrom, although there is no risk for a fall or collision.

It would thus be beneficial if the computational demanding determination, if a user is about to fall or collide when doing the indented activity, e.g., riding a bicycle, is deactivated when it's not needed so as to reduce the overall energy consumption of the system. The system herein aims at determining if the airbag system is needed, in particular if a user is actually performing the intended activity or not. This information may for example be used to change the mode of the airbag system 100.

Figure 1:
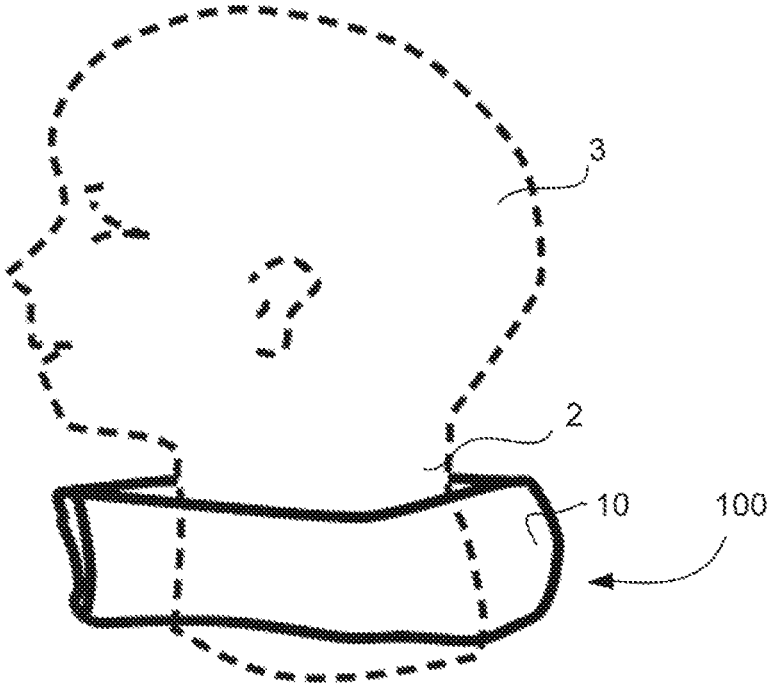
FIG. 1 is a schematic view of a user wearing an inflatable helmet, including an airbag system according to some embodiments.

FIG. 1 shows an airbag system 100 according to an embodiment in its non-inflated state. The airbag system 100 forms an apparel having the shape of a collar 10 which is worn around the neck 2 of a user 3. Upon inflation, the apparel transforms into an inflated helmet.

The collar 10 is placed around the neck of the user and has for that purpose a sealable opening 12, normally at the front of the collar. Alternatively, the opening 12 may be arranged at the back of the collar 10 or at the shoulder portion of the collar 1. Furthermore, the opening 12 may be totally or partly dividable.

In one embodiment, the opening 12 is sealed using interlocking means (not shown) to connect the ends of the collar 10 e.g. adjacently the user's 3 throat or neck region. The interlocking means facilitates easy dressing and undressing of the collar 10 on the user 3. Furthermore, the position of the different parts of the interlocking means may be configured so that it determines if the airbag system 100 is turned on (i.e. having power) or turned off, and if its turned on in an active state or in an idle state.

In another embodiment the sealing may be arranged with a zipper, buttons, a Velcro fastening, magnets, hooks, hanks, buckles, safety pins, straps or the like. The collar 10 may be made of any kind of flexible material, such as acetate silk, jeans, fleece, cotton, beaver nylon or any other suitable fabric.

When the airbag system is not worn by the user, the collar 10 can be put in a resting position to allow the user to easier carry the collar 10 for example by putting it in a bag. All electronics in the airbag system is turned off when the airbag system is put in the resting position. In the resting position the collar is connected such that the diameter of the collar is greatly reduced. This prevents the user from being able to have to collar 10 arranged around the neck when the collar is in its resting position.

The collar 10 comprises a folded airbag 20 which is inflated to form a helmet for protecting the head of the user 3 in case of an abnormal movement, e.g. during a cycling accident.

Figure 2:
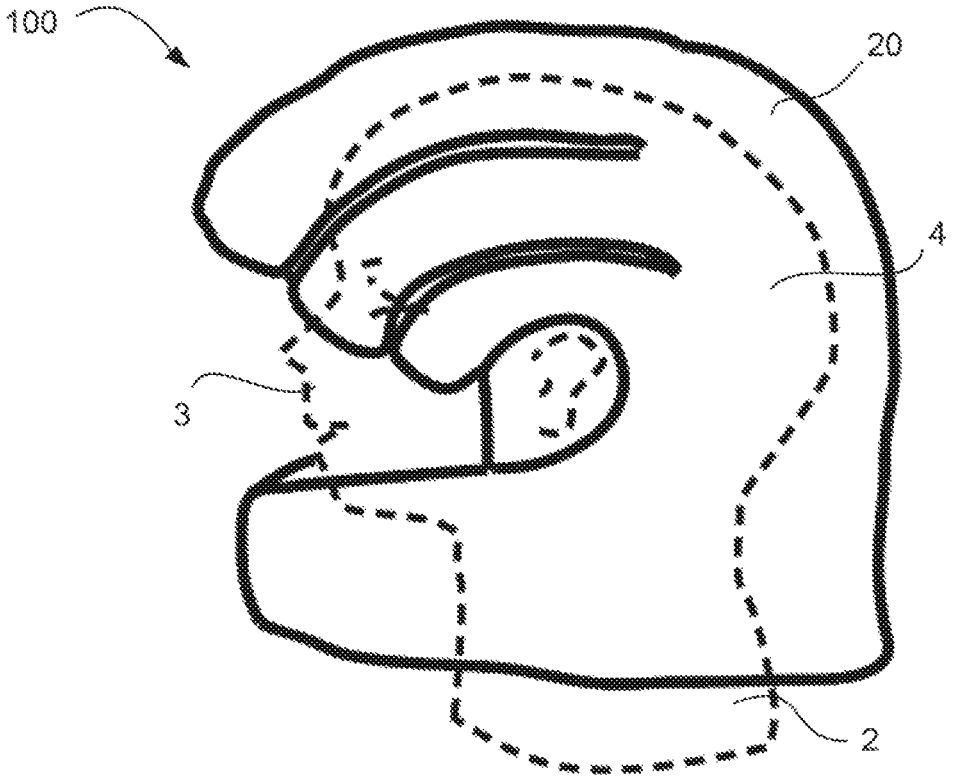
FIG. 2 is a schematic view of a user wearing an inflated helmet, including an airbag system according to some embodiments.

An inflated helmet is schematically shown in FIG. 2. Here, the collar 10 is opened to release the airbag 20 previously enclosed therein. The airbag 20 surrounds the neck 2 and the head 4 of the user 3 and provides an efficient protection for the user 2.

The airbag 20 is formed by a flexible material in order to be folded and stored within the collar 10 prior to inflation. The airbag 20 may e.g. comprise an inflatable inner bag surrounded by an outer bag. Inflation of the inner bag leads to expansion of the outer bag and the structure of the outer bag defines the shape of the airbag when the inner bag is inflated. Although not shown in FIGS. 1 and 2, the airbag system may also be a one-bag construction.

The inner bag may be made of a fluid impermeable material, such as thermoplastic polyurethane film. Since fluid cannot easily leave a fluid impermeable bag, a person wearing an airbag 20 according to the invention will be protected by said airbag 20 for some time after expansion of the airbag 20, effectively protecting the head of the user for the entire time of the accident. The inner bag may be flexible and expandable such that it may expand the outer bag upon inflation to a high pressure. Hence, the inner bag may be inflated resulting in a relatively high internal pressure which preferably is maintained for some time.

An example of how the inner and outer bag may be configured is described in WO2012044245 by the same applicant.

Figure 3:
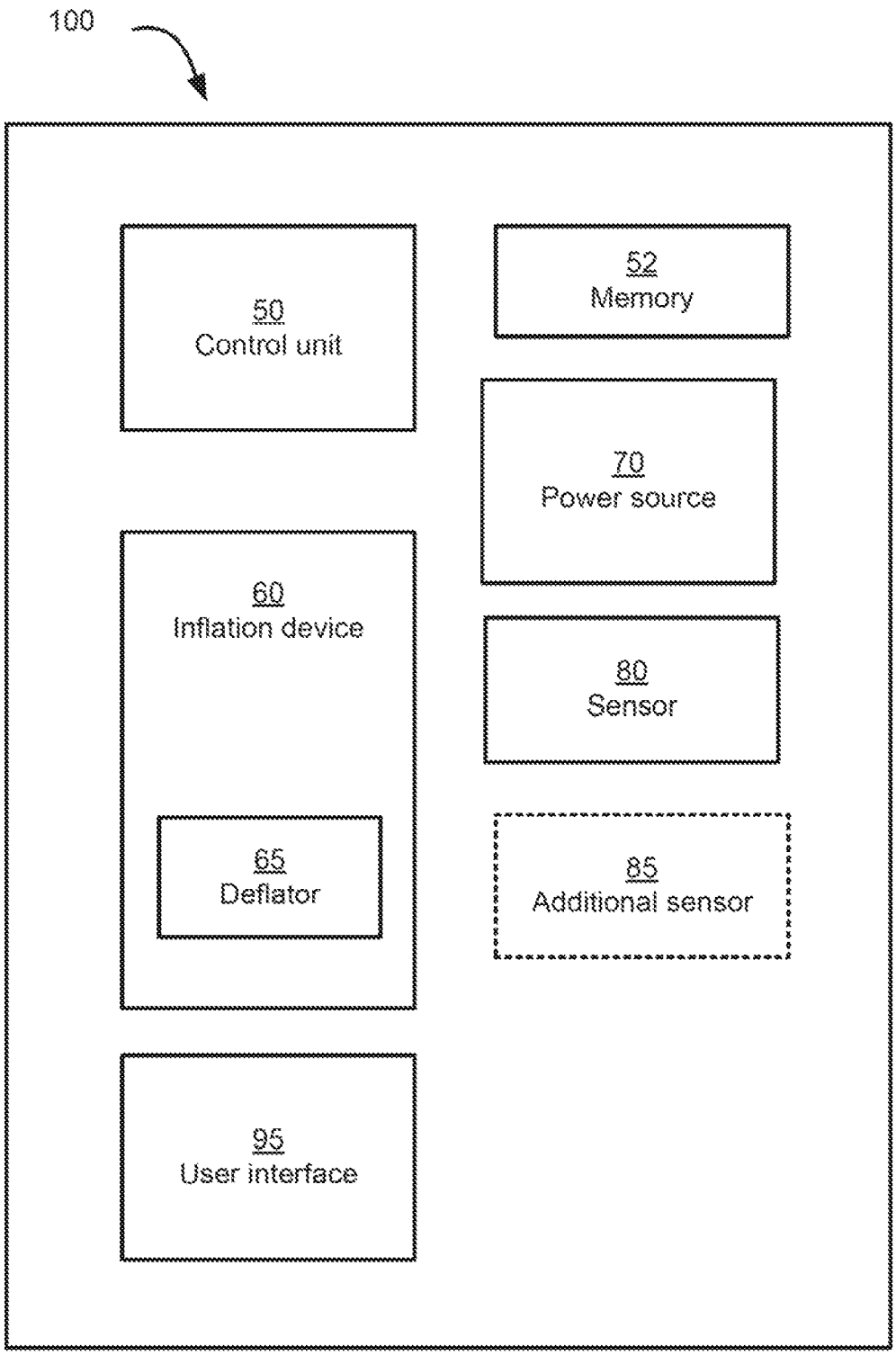
FIG. 3 is a schematic view of an airbag system according to an embodiment.

As shown in FIG. 3, the airbag system 100 further comprises at least one sensor 80 for detecting movement of the collar 10, i.e. movement of the user 3 during use, and a control unit 50 configured to in response to the information gained by the sensor 80 determine if the movement corresponds to an accident situation. If an accident situation is determined, the control unit 50 will trigger inflation of the airbag 20 by means of an inflation device 60. The airbag system 100 further comprises a power source 70, for example a rechargeable battery or a disposable battery, in order to provide electricity to the parts of the system 100. The different parts will now be described more in detail.

The inflation device 60 may be any suitable type of airbag inflation device, such as a hybrid generator using a combination of compressed gas and solid fuel, a pyrotechnic airbag inflator which uses hot gases formed by powder, a heated gas inflator, or a an inflation device using solid fuel. In an embodiment, the inflation device 60 is a cold gas inflator.

The inflation device 60 may further be provided with a gas guide 65, for directing the gas into the airbag. The inflation device 60 is clamped, screwed, glued, sewed or the like onto the textile bag and the gas guide 65 is positioned inside the textile bag for directing the gas into the bag for inflating the airbag in a proper manner. The gas guide 65 may be T-shaped for being able to lead the gas into the airbag in a suitable stable way. Alternatively the gas guide 65 may be Y-shaped, I-shaped, arrow-shaped, multiple-part shaped cylindrical shaped or the like.

The inflation of the airbag 20 is controlled by the control unit 50. The control unit 50 controls the inflation of the airbag in case of an abnormal movement and prevents the airbag system from inflation at an undesired occasion. The control unit 50 may be implemented using instructions that enable hardware functionality, for example, by using executable computer program instructions in a general-purpose or special-purpose processor that may be stored on a computer readable storage medium (disk, memory etc.) 52 to be executed by such a processor. The control unit 50 may be configured to read instructions from the memory 52 and execute these instructions to control the operation of the airbag system 100. The control unit 50 may be implemented using any suitable, publicly available processor or Programmable Logic Circuit (PLC). The memory 52 may be implemented using any commonly known technology for computer-readable memories such as ROM, RAM, SRAM, DRAM, FLASH, DDR, SDRAM or some other memory technology.

The control unit 50 may be a dedicated control unit or the control unit may also be configured to control other functions.

The at least one sensor 80 collects data relating to the movement of the collar 10. The sensor 80 may e.g. be an accelerometer, a gyro, an air ultrasonic transducer, radar and/or a laser. In one embodiment at least one sensor 80 is an accelerometer measuring acceleration in three dimensions and/or the sensor 80 is a gyro detecting angular speed in three dimensions. Additionally, or alternatively, the at least one sensor 80 may be a air ultrasonic transducer, or any device using electromagnetic waves, that measures the distance from the ground to the collar.

EP2313814, filed by the same applicant, discloses a method for detecting a bicycle accident without falsely classifying any data samples from normal cycling activities as accident. The system classifies the detected movement into either a "normal class" relating to movement patterns representing riding a bicycle or doing related activities or into an "action class" relating to movement patterns representing a bicycle accident.

The movement data gathered from the at least one sensor 80 is transmitted to the control unit 50. The control unit 50 processes the data and analyses it in order to evaluate if the processed data corresponds to an accident situation. If the data corresponds to pre-stored data indicating an accident situation, the control unit 50 transmits a triggering signal to the inflation device 60 to trigger the inflation of the airbag 20. The airbag 20 will consequently be inflated when the inflation device 60 receives the triggering signal.

The controller is coupled to the memory 52, which saves the measured and processed data. The saved data can be used to review and analyse the activity history of the airbag system. This is particularly useful if the airbag system has been deflated and technicians want to verify that the airbag system was working properly.

If the user 3 wears the airbag system 100 when performing an activity for which the airbag system 100 was not intended, such as climbing or riding an elevator, there is a slight risk that the control unit 50 incorrectly detects the movement as an accident and triggers the inflation. It would thus be beneficial to determine between when a user 3 is doing the intended activity, e.g. riding a bicycle, and/or when the user is doing an un-intended activity, such as climbing or running, and to subsequently alarm the user 3 if he/she is doing an un-intended activity with the airbag system 100 and that the airbag system 100 should be turned off or turned into an idle state, as will soon be described. The determination could either be done by determining if the user is doing the intended activity (e.g. bicycling), determining if the user is doing an unintended activity (e.g. activity other than bicycling) and/or determining both if the user is doing the intended activity or an unintended activity.

The determination of when a user 3 is in a first activity state, pertaining to an un-intended activity, is preferably done using movement data gathered by the airbag system 100. The movement data used to determine the activity state of the user (e.g. walking or bicycling) may be retrieved from the at least one sensor 80 and/or from at least one additional sensor 85.

The additional sensor 85 may be an accelerometer, a gyro, an air ultrasonic transducer, radar and/or a laser or any other suitable sensor. The movement signals used to determine the activity state of the user may comprise information relating to acceleration, angular speed and/or the distance from the ground to the collar.

The airbag system 100 may further comprise a user interface 95. The user interface 95 produces a signal detectable by the user, so as to alert the user 3 with different information. The user interface 95 may be used to alert the user 3 that the airbag system 100 is turned on although the user is in a first activity state, e.g. walking.

The user interface 95 may also be configured to indicate the status of the airbag system, i.e. the battery level, if the battery is in need for change or charging, if the inner elements of the helmet is intact or not, and if the system is turned on. The user interface 90 may also indicate if the system is turned on in an idle state or an active state.

The alert signal could be in the form of an audible signal such as siren, a haptic signal such as a vibration, a visual signal such as a strobe light or other sensory alarm that could be arranged on a user in the form of an airbag system 100.

The user interface 95 may comprise one or a plurality of light emitting diodes (LED), which indicate information using light signal(s). Different colors of the light or flashing signals may for example indicate different information. The user interface 95 may also comprise a speaker sending out a sound signal, such as a buzz, or a device sending out a vibrating signal or a spoken phrase.

The airbag system 100 has to be turned on, i.e. having power, in order to work properly. In one embodiment the airbag system 100 is turned on using an on/off-button arranged somewhere on the collar 10. In yet one embodiment, the airbag system 100 is turned on automatically once the collar 10 is placed and secured around the neck 2 of the user 3.

In some embodiments, the airbag system 100 may either be turned on in an active state or in an idle state. In the active state all parts of the airbag system 100 are active and the airbag is thus allowed to be inflated by a triggering signal from the sensor 80. In the idle state the airbag systems 100 is powered up but other functions may be idle. In idle state, the control unit 50 and the sensor(s) 80, 85 used for determining the activity state of the user may be active whereas the inflation device 60 is inactivated (i.e. the airbag is not allowed to be inflated by a triggering signal). In these embodiments it is preferred that the airbag system 100 is in an idle state when the user 3 is wearing the airbag system 100 for other activities than the intended activity. This eliminates or at least diminish the risk of the airbag being inflated unintentionally.

In one embodiment, the idle state and the active state is turned on/off by the interlocking means arranged on the collar 10. The interlocking means comprises a first fastening body and a second fastening body. One end of the first and second fastening body are each connected to the collar 10. The collar 10 is thus easily attached to the neck of the user by attaching the first fastening body and the second fastening body to each other, and the collar 10 is released from the neck of the user 3 by detaching the first and second fastening bodies from each other. In a preferred embodiment, the first and second fastening body are a female and male connector.

The interlocking means is configured to be arranged in a first locking position or a second locking position when the first fastening body and the second fastening body are connected to each other. When the interlocking means is in a first locking position, the system 100 is put into an idle state and when the interlocking means is in a second locking position, the system 100 is put into an active state.

Figure 4A:
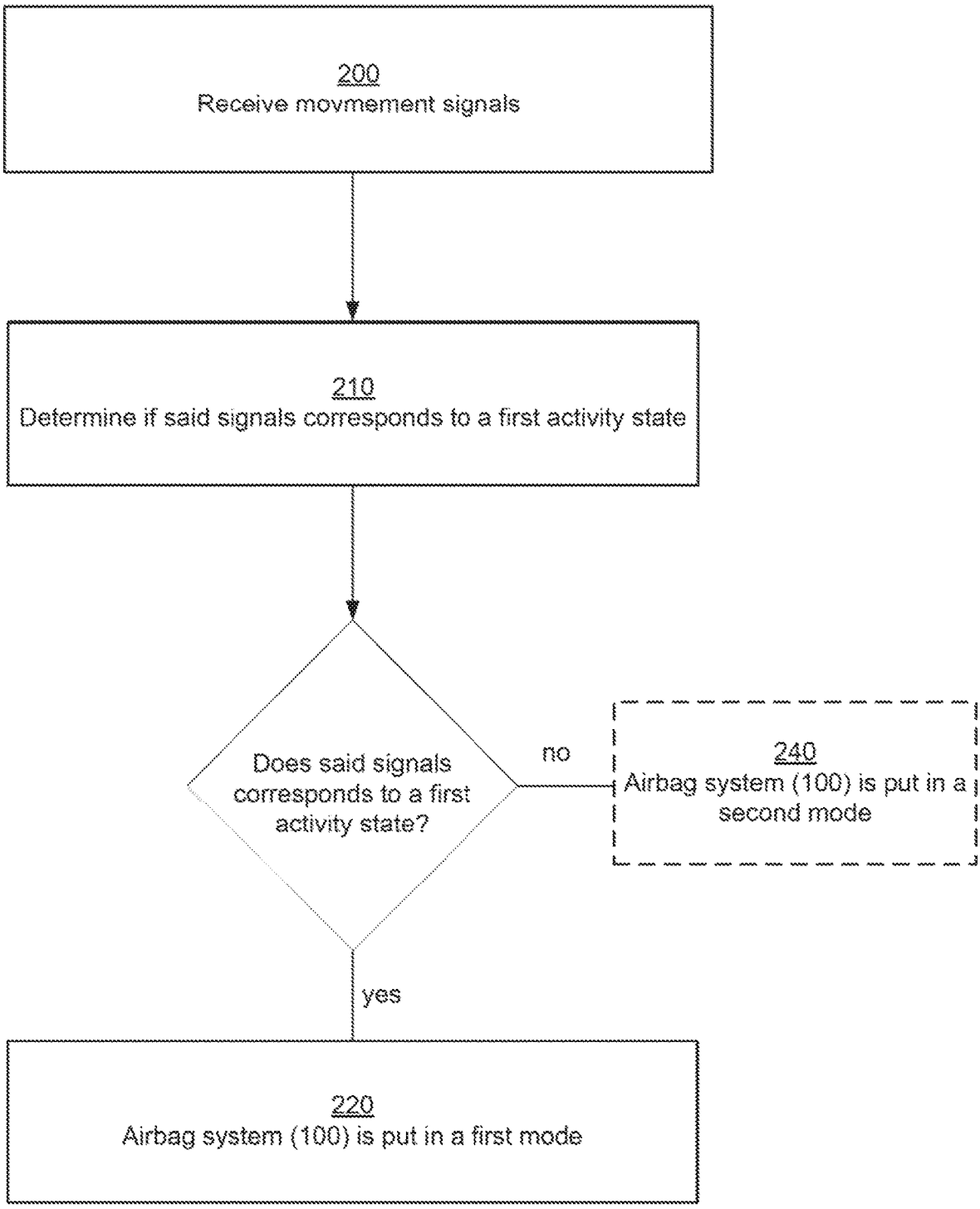
FIGS. 4*a-c* are schematic views of methods according to different embodiments.

As seen in FIG. 4*a*, in one embodiment the control unit 50 is configured to determine if the user 3 is in a first activity state based on a movement signal or movement signals from the at least one sensor 80 and/or the at least one additional sensor 85. The control unit 50 is configured to receive 200 the movement signal(s) and process the signal(s) to determine 210 if it corresponds to a predetermine pattern indicating the first activity state. If the signal(s) corresponds to the first activity state, i.e. if it is determined that the current activity is different from the intended activity, the control unit 50 is configured to put 220 the airbag system 100 in a first mode. Depending on configuration the first mode may pertain to different functions such as alerting the user 3 to alert him/her to manually change the system into an idle state and/or automatically configuring the airbag system 100 to be in an idle state.

In order to save power consumption, the at least one sensor 80 and/or the at least one additional sensor 85 used to determine the activity state may send signals at a predetermined time interval instead of continuously measuring the state. Such a time interval may for example be every 30 seconds, every minute or every second minute. The sensors may also be configured to determine the activity state more seldom, such as every fifth minute.

In one embodiment, the control unit 50 being in a first mode is configured to alert the user 3. The control unit 50 may be configured to alert the user 3 by transmitting a signal to the user interface 95 which subsequently alerts the user 3. In this way the user 3 is alerted that the airbag system 100 is turned on although he/she is not currently doing the intended activity, such as riding a bicycle. The alert prompts the user 3 to turn off the airbag system 100 or to manually configure the airbag system 100 in an idle state.

In one embodiment the control unit 50 being in the first mode is configured to automatically set the airbag system 100 in an idle ON-state when the user 3 is not doing the intended activity (i.e. the user is in a first activity state), thus disabling the inflation functionality. This has the benefit that it reduces the risk of incorrect inflation due to the user performing other actions (such as running, walking, jumping, etc.) than the intended action. Additionally, determining between the normal activity state, such as riding a bike, and being in an accident, such as a fall or collision, requires significant amount of data power whereas determining if the user 3 is in a first activity state (e.g. doing an unintended activity) requires less data power. It is thus possible to reduce the energy consumption of the airbag system 100 by putting the system in an idle ON-state when the user is in a first activity state.

In one embodiment, when the airbag system 100 is in a first mode, the control unit 50 is configured to set the airbag system 100 in an idle state automatically and as an optional step, the system may also alert the user 3 that the state of the airbag system 100 has been changed to the idle state. If the system 100 already was in an idle state before the detection, no further action needs to be done.

In some embodiments, if the control unit 50 determines that the movement signal(s) does not correspond to a first activity state of the user 3, no further actions is done. In alternative embodiments, if the control unit 50 determines that the movement signal(s) does not correspond to a first activity state of the user 3, the control unit 50 may be configured to put the airbag system 100 in a second mode 240. This optional step 240 is illustrated in FIG. 4*a* by the dotted line.

Figure 4B:
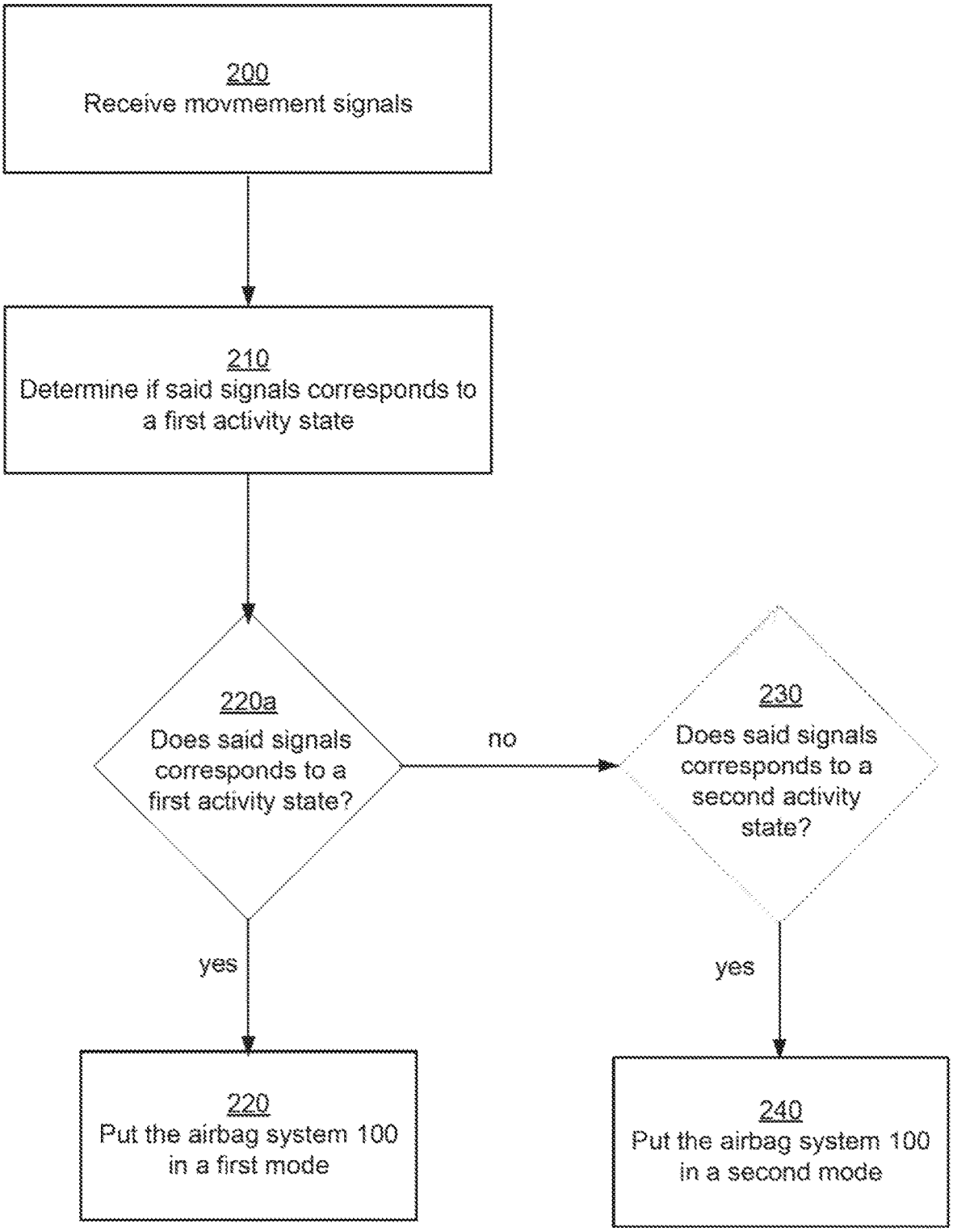

FIG. 4*b* shows an embodiment where the control unit 50 receives one or a plurality of movement signals and based on said signal(s) determines 210 if the signals correspond to a first activity state. If the signals correspond 220*a* to a first activity state, the control unit 50 is configured 220 to ensure that the airbag system 100 is in a first mode.

If the signal does not correspond to the first activity state, the control unit 50 may as an additional step determine 230 if the movement signals corresponds to a second activity state and if so, put the airbag system 100 into a second mode.

In one embodiment the airbag system 100 being in a second mode is automatically configured to put the airbag system 100 in an active state and/or to alert the user to manually change to an active state. As an optional step, the system may also alert the user 3 that the airbag system 100 has been turned into an active state. If the system 100 already was in an active state before the determination, no further action needs to be done.

Alternatively, as described as an additional step with reference to FIG. 4*a*, if the signal does not correspond to the first activity state, the control unit 50 is configured to configure the airbag system 100 in a second mode immediately. Hence, in this embodiment the control unit 50 does not determine if the movement data corresponds to a second activity state.

Figure 4C:
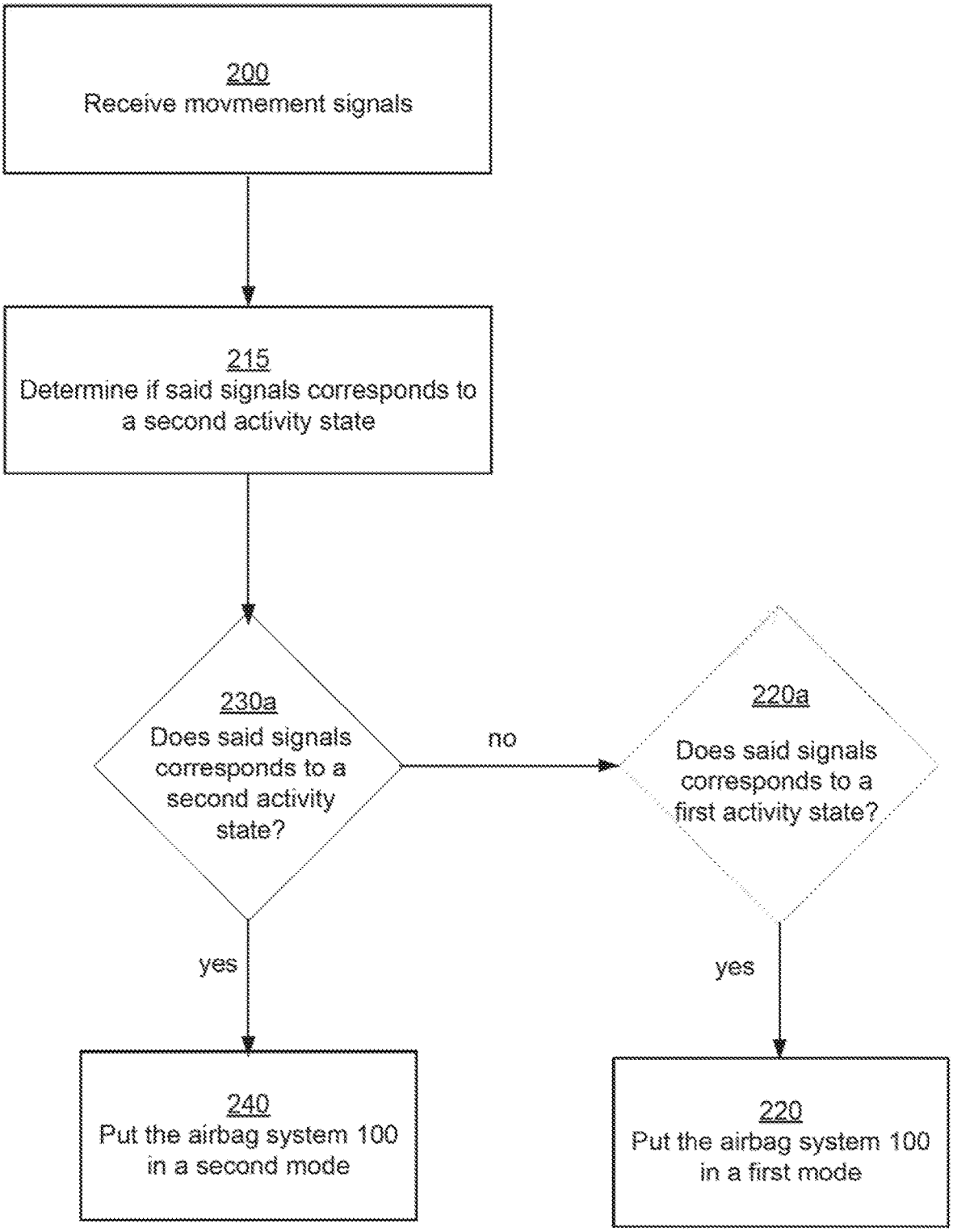

FIG. 4*c* shows an embodiment where the control unit 50 receives one or a plurality of movement signals and based on said signal(s) determines 215 if the signals correspond to a second activity state (e.g. bicycling). If the signals correspond 230*a* to a second activity state, the control unit 50 is configured 220 to ensure that the airbag system 100 is in a second mode.

If the signal does not correspond to the second activity state, the control unit 50 may as an additional step determine 230 if the movement signals corresponds to a first activity state (e.g. not bicycling) and if so, put the airbag system 100 into a first mode.

Alternatively, as described as an additional step with reference to FIG. 4*a*, if the signal does not correspond to the second activity state, the control unit 50 is configured to configure the airbag system 100 in a first mode immediately. Hence, in this additional step the control unit 50 does not determine if the movement data corresponds to a first activity state.

In the embodiments discussed with reference to FIGS. 4*a-c*, the first activity state of the user is the user doing an un-intended activity. If the intended activity for the airbag system is riding a bicycle, the first activity state is all other activities than bicycling. For example, the system 100 could determine that the user is in a first activity state by detecting, by the sensor(s) 80, 85 that the user is standing still, and thus determine that the user is in a first activity state. If the user is standing still, no movement data is gathered which is an indication that the user is not doing the indented activity.

In the embodiment where the second activity state is determined, said second activity state is the intended activity, such as for example riding a bicycle. Hence, the second activity state represents the activity which the airbag system 100 is intended for.

It is apparent to a person skilled in the art that the basic idea may be implemented in various ways. The invention and its embodiments are thus not limited to the examples described above; instead they may vary within the scope of the claims.

The invention claimed is:

1. An airbag system for protecting a body part of a user in case of an accident, comprising:

an airbag;

an inflation device to inflate the airbag in response to an accident occurring during an intended activity state, the intended activity state being the user riding a bicycle;

at least one sensor configured to measure movements of the airbag system, and thus indirectly the movements of the user, and generate at least one output signal indicative of the movements;

a control unit configured to receive the at least one output signal from the at least one sensor and determine an activity state of the user by processing the at least one output signal, the activity state determined by the control unit being one of the intended activity state or an alternate activity state in which the movements are indicative of the user doing an activity other than riding a bicycle; and the control unit further configured to receive the at least one output signal and detect a movement indicative of an accident, wherein the control unit transmits a trigger signal to the inflation device and the inflation device inflates the airbag in response to the detection of the movement indicative of the accident when the activity state is determined to be the intended activity state, and wherein the inflation device does not inflate the airbag in response to the detection of the movement indicative of the accident when the activate state is determined to be the alternate activity state.

2. The airbag system according to claim 1, wherein the control unit of the airbag system is configured to automatically put the airbag system in an idle state, and/or alert the user to manually change to the idle state, in response to the control unit determining that the user is in the alternate activity state.

3. The airbag system according to claim 2, wherein the airbag system further comprises a user interface, wherein said user interface is configured to alert the user by producing a signal detectable by the user.

4. The airbag system according to claim 2, wherein when the system is in the idle state the airbag cannot be inflated.

5. The airbag system according to claim 1, wherein the control unit of the airbag system is configured to automatically put the airbag system in an active state, and/or alert the user to manually change to the active state, in response to the control unit determining that the user is not in the alternate activity state.

6. The airbag system according to claim 1, wherein the control unit is configured to automatically put the airbag system in an active state, and/or alert the user to manually change to the active state, in response to the control unit determining that the user is in the intended activity state.

7. The airbag system according to claim 6, wherein the control unit of the airbag system is configured to automatically put the airbag system in an idle state, and/or alert the user to manually change to the idle state, in response to the control unit determining that the user is not in the intended activity state.

8. The airbag system according to claim 1, wherein the at least one sensor is further configured to detect abnormal movement of the user corresponding to an accident.

9. The airbag system according to claim 1, wherein the system further comprises an additional sensor configured to detect abnormal movement of the user corresponding to an accident.

10. A method for use in an airbag system comprising an airbag adapted for inflation upon an accident occurring during an intended activity state of a user riding a bicycle, at least one sensor configured to measure movements of the airbag system, and a control unit, said method comprising:

receiving movement data from the at least one sensor, determining an activity state based on the received movement data, the activity state being determined as the intended activity state or a first activity state, wherein the first activity state is the user doing an activity other than riding a bicycle, detecting an accident based on the received movement data and generating a triggering signal, and inflating the airbag to be inflated in response to the triggering signal when the activity state is determined to be the intended activity and not inflating the airbag when the activity state is determined to be the first activity state.

11. The method according to claim 10, further comprising:

automatically putting the airbag system in an idle state, and/or alerting the user to manually change to the idle state, when it is determined that the user is in the first activity state.

12. The method according to claim 10, further comprising:

automatically putting the airbag system in an active state, and/or alert the user to manually change to the active state, when it is determined that the user is in the intended activity state.

13. An airbag system for protecting a body part of a user in case of an accident, comprising:

an airbag;

an inflation device to inflate the airbag in response to an accident occurring during an intended activity state, the intended activity state being the user riding a bicycle;

at least one sensor configured to measure movements of the airbag system, and thus indirectly the movements of the user, and generate at least one output signal indicative of the movements;

a control unit configured to receive the at least one output signal from the at least one sensor and determine an activity state of the user by processing the at least one output signal, the activity state determined by the control unit being one of the intended activity state or an alternate activity state in which the movements are indicative of the user doing an activity other than riding a bicycle; and the control unit further configured to receive the at least one output signal and detect a movement indicative of an accident only when the activity state is determined to be the intended activity state, wherein the control unit transmits a trigger signal to the inflation device and the inflation device inflates the airbag in response to the detection of the movement indicative of the accident when the activity state is determined to be the intended activity state, and wherein the inflation device does not inflate the airbag when the activate state is determined to be the alternate activity state.

14. A method for use in an airbag system comprising an airbag adapted for inflation upon an accident occurring during an intended activity state of a user riding a bicycle, at least one sensor configured to measure movements of the airbag system, and a control unit, said method comprising:

receiving movement data from the at least one sensor, determining an activity state based on the received movement data, the activity state being determined as the intended activity state or a first activity state, wherein the first activity state is the user doing an activity other than riding a bicycle, detecting an accident based on the received movement data only when the activity state is determined to be the intended activity state and generating a triggering signal, and inflating the airbag to be inflated in response to the triggering signal when the activity state is determined to be the intended activity and not inflating the airbag when the activity state is determined to be the first activity state.

* * * * *